US011191689B1

(12) United States Patent
Terebus

(10) Patent No.: US 11,191,689 B1
(45) Date of Patent: Dec. 7, 2021

(54) DUAL LEVER ARM ASSIST TOOL FOR INDIVIDUALS AND CARE GIVERS

(71) Applicant: James Z. Terebus, Warren, MI (US)

(72) Inventor: James Z. Terebus, Warren, MI (US)

( * ) Notice: Subject to any disclaimer, the term of this patent is extended or adjusted under 35 U.S.C. 154(b) by 0 days.

(21) Appl. No.: 17/168,720

(22) Filed: Feb. 5, 2021

Related U.S. Application Data

(60) Provisional application No. 62/970,494, filed on Feb. 5, 2020.

(51) Int. Cl.

| | |
|---|---|
| ***A61G 7/10*** | (2006.01) |
| ***A61G 5/12*** | (2006.01) |
| ***A61H 3/00*** | (2006.01) |
| *A61H 3/02* | (2006.01) |

(52) U.S. Cl.
CPC ..... *A61G 7/1038* (2013.01); *A61G 5/12* (2013.01); *A61H 3/00* (2013.01); *A61H 3/02* (2013.01); *A61H 2003/0216* (2013.01)

(58) Field of Classification Search
CPC ..... A61H 5/14; A61H 7/1038; A61G 5/14; A61G 7/1038
See application file for complete search history.

(56) References Cited

U.S. PATENT DOCUMENTS 3,237,215 A * 3/1966 Fried ..... A47C 20/027 5/632
D208,607 S * 9/1967 Williams ..... D3/7
3,591,173 A * 7/1971 Cossman ..... A63B 21/00047 482/142
3,739,793 A * 6/1973 Wilson ..... A61G 7/053 5/503.1
4,232,863 A * 11/1980 Roach ..... A63B 21/00047 482/141
4,932,653 A * 6/1990 Schwartz ..... A63B 17/00 482/42
4,941,495 A * 7/1990 Boyce ..... A61G 7/053 135/65
5,234,391 A * 8/1993 Shasek ..... A63B 3/00 482/111
5,295,498 A * 3/1994 Van Meter ..... A61G 5/14 135/65
5,397,169 A * 3/1995 Willans ..... A61G 5/14 297/411.23

(Continued)

FOREIGN PATENT DOCUMENTS

GB 190884 A * 1/1923 ..... E04H 15/60
WO WO-2020154560 A1 * 7/2020 ..... A61G 5/14

*Primary Examiner* — David R Dunn
*Assistant Examiner* — Danielle Jackson
(74) *Attorney, Agent, or Firm* — Christopher P. Maiorana, P.C.

(57) ABSTRACT

An apparatus comprises a tubular structure. The tubular structure generally comprises a U-shaped portion, a first lever arm, and a second lever arm. The first lever arm generally comprises a first curved portion, a first straight portion, and a first bent portion. The second lever arm generally comprises a second curved portion, a second straight portion and a second bent portion. The U-shaped portion is generally aligned within a first plane. The first lever arm is generally aligned within a second plane. The second lever arm is generally aligned within a third plane. The second and the third planes are generally parallel to each other and perpendicular to the first plane.

16 Claims, 16 Drawing Sheets

(56) References Cited

U.S. PATENT DOCUMENTS

D365,314 S * 12/1995 Heisinger ..... D12/130
D379,836 S * 6/1997 Chen ..... A61G 7/053 D21/691
5,697,628 A * 12/1997 Spear ..... A61G 5/12 280/304.1
5,728,035 A * 3/1998 Sands ..... A63B 23/0211 482/132
D400,953 S * 11/1998 Huang ..... D21/687
6,196,949 B1 * 3/2001 Rodarte ..... A47D 13/04 434/255
6,203,473 B1 * 3/2001 Atwood ..... A63B 21/00047 482/142
6,332,232 B1 * 12/2001 Neal ..... A61G 7/053 297/411.23
D496,701 S * 9/2004 Chung ..... D21/662
6,860,281 B1 * 3/2005 Clift ..... A61G 7/1038 135/66
7,357,761 B2 * 4/2008 Mattox ..... A63B 21/0004 482/125
7,363,931 B2 * 4/2008 Weaver ..... A61G 7/1038 135/66
7,775,228 B2 * 8/2010 Clark ..... A61G 7/1038 135/66
7,862,122 B1 * 1/2011 Shammas ..... B60N 2/787 297/411.23
8,166,987 B2 * 5/2012 Weaver ..... A61G 5/14 135/67
8,267,840 B2 * 9/2012 Barnes ..... A63B 21/00047 482/95
8,973,192 B2 * 3/2015 Miller ..... A47C 21/08 5/662
9,561,146 B2 * 2/2017 Miller ..... A47C 31/00
9,573,018 B2 * 2/2017 MacColl ..... A63B 21/00047
10,085,906 B2 * 10/2018 Zhao ..... A61G 5/14
10,292,884 B2 * 5/2019 Silverstein ..... A61G 7/053
10,744,051 B2 * 8/2020 Virgo ..... A45B 7/00
10,835,433 B2 * 11/2020 Schwab ..... A61G 7/1007
2002/0089227 A1 * 7/2002 Speraw ..... A47C 16/04 297/423.11
2005/0066430 A1 * 3/2005 Bly ..... A47K 17/026 4/254
2005/0187083 A1 * 8/2005 Krystoff ..... A63B 21/00047 482/140
2007/0135281 A1 * 6/2007 Liao ..... A63B 21/4047 482/140
2007/0281840 A1 * 12/2007 Tsai ..... A63B 23/0211 482/140
2016/0095770 A1 * 4/2016 Gordin ..... A61G 7/1038 297/183.4
2017/0189252 A1 * 7/2017 Silver ..... A61G 7/1038
2019/0175429 A1 * 6/2019 Silverstein ..... A61G 7/1011

* cited by examiner (d)

(e)

(f)

DUAL LEVER ARM ASSIST TOOL FOR INDIVIDUALS AND CARE GIVERS

This application relates to U.S. Provisional Application No. 62/970,494, filed Feb. 5, 2020, which is hereby incorporated by reference in its entirety.

FIELD OF THE INVENTION

The invention relates to personal assist devices generally and, more particularly, to a method and/or apparatus for implementing a dual lever arm assist tool for individuals and care givers.

BACKGROUND

Care givers and first responders can need to help individuals found lying down sit up and rise to a standing position. In helping the individual, care givers and first responders can strain, or more seriously injure, their backs, and possibly injure the individual. Hospital stays can require staff to lift and move patients in beds. During hospitalization, it can be necessary for patients to get in and out of bed, for example to use restrooms and other facilities. For individuals who are unsteady on their feet, hospital staff generally need to provide assistance to prevent falls. When providing assistance, hospital staff can injure themselves while straining to ensure the safety of the individual.

It would be desirable to implement a dual lever arm assist tool for individuals and care givers.

SUMMARY

The invention concerns an apparatus comprising a tubular structure. The tubular structure generally comprises a U-shaped portion, a first lever arm, and a second lever arm. The first lever arm generally comprises a first curved portion, a first straight portion, and a first bent portion. The second lever arm generally comprises a second curved portion, a second straight portion and a second bent portion. A first end of the U-shaped portion is generally connected to a first end of the first curved portion of the first lever arm. A second end of the U-shaped portion is generally connected to a first end of the second curved portion of the second lever arm. A second end of the first curved portion may be connected to a first end of the first straight portion of the first lever arm. A second end of the second curved portion may be connected to a first end of the second straight portion of the second lever arm. A second end of the first straight portion of the first lever arm is generally removably connected to the first bent portion of the first lever arm. A second end of the second straight portion of the second lever arm is generally removably connected to the second bent portion of the second lever arm. The U-shaped portion is generally aligned within a first plane. The first lever arm is generally aligned within a second plane. The second lever arm is generally aligned within a third plane. The second and the third planes are generally parallel to each other and perpendicular to the first plane.

BRIEF DESCRIPTION OF THE FIGURES

Embodiments of the invention will be apparent from the following detailed description and the appended claims and drawings in which:

DETAILED DESCRIPTION OF THE EMBODIMENTS

Figure 1:
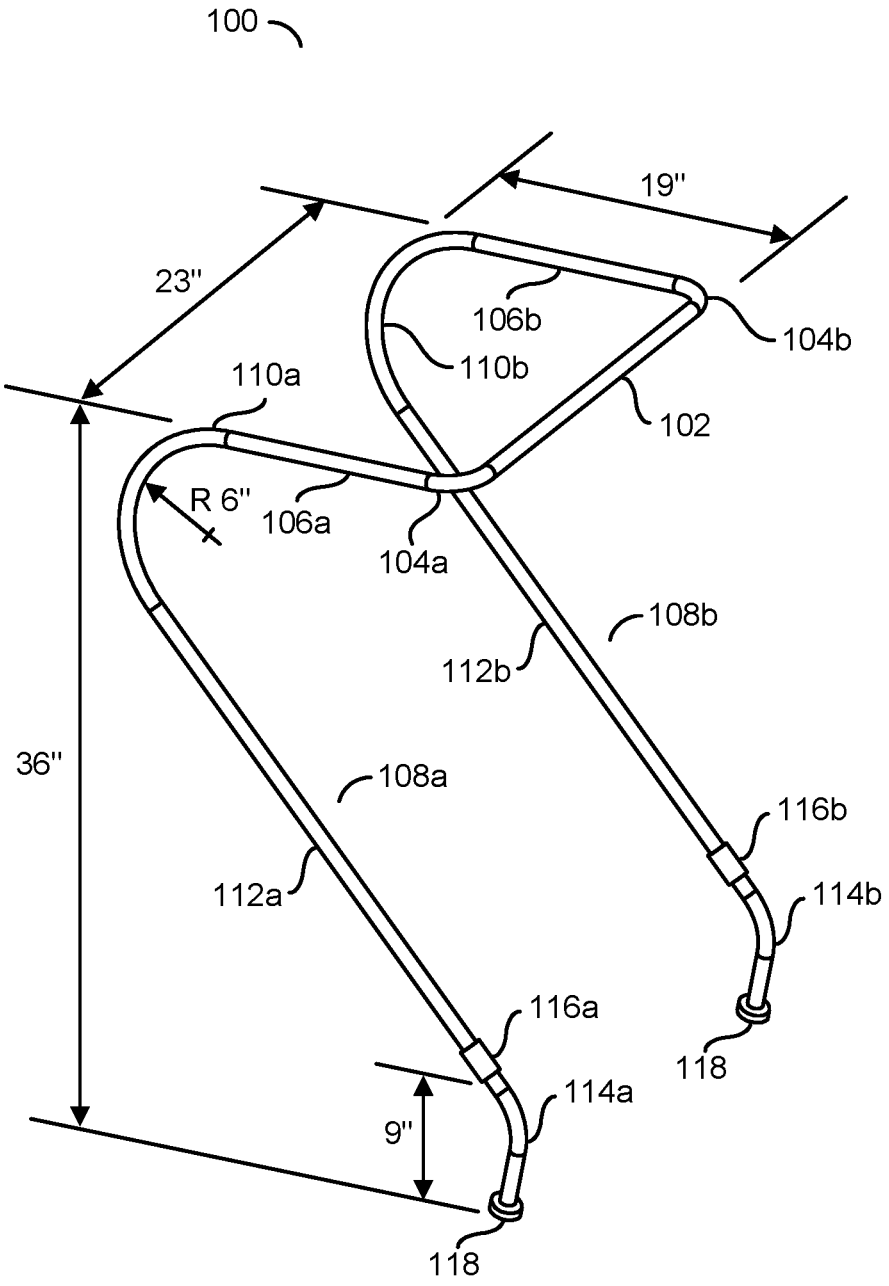
FIG. 1 is a diagram illustrating a dual lever arm assist tool in accordance with an embodiment of the invention.

Embodiments of the present invention include providing a dual lever arm assist tool for individuals and care givers that may (i) help patients perform exercises in bed, (ii) help patients sit up with supervised direction, (iii) relieve nurses from having to strain to lift patients to adjust their position in bed, (iv) reduce chances of care givers and/or first responders incurring back injury from assisting patients in moving between different positions (e.g., lying, sitting, kneeling, standing, etc.), (v) provide leverage and counterbalance to assist an individual or patient with getting into and out of a wheelchair, (vi) assist an individual or patient with getting into and out of bed, (vii) assist an individual or patient with maintaining a desired posture during exercise, (viii) assist an individual or patient maintaining a stability, (ix) reduce chances of an individual or patient suffering a fall, (x) be easily manufactured, (xi) use heat shrink tubing to apply non-slip surface on tool, and/or (xii) be easily stored out of the way when not in use.

In various embodiments, an apparatus and a method are provided to assist people caring for individuals, as well as the individuals themselves, to safely lift the individuals from a lying position to a sitting position, from a siting position to a kneeling position, from a kneeling position to a standing position, from a seated position to a standing position, from sitting on a bed to standing next to the bed, and vice versa, using leverage and balance. The apparatus and methods in accordance with embodiments of the invention generally help first responders, care givers, and the individuals themselves to avoid injuries due to straining during positional changes. In various embodiments, the apparatus in accordance with embodiments of the invention provides leverage (mechanical advantage) that magnifies the muscle strength of an individual in a controlled fashion, which may reduce a chance of injury (e.g., muscle strains, etc.).

In an example, the apparatus in accordance with embodiments of the invention may be used by an individual to provide balance during exercises to strengthen their body. The apparatus may allow individuals to more easily maintain postures that may maximize a benefit of a particular exercise. The apparatus may allow individuals who are unsteady in their body movements to be more confident in moving around their environment.

In an example, the apparatus in accordance with embodiments of the invention may provide benefits to first responders and care givers (e.g., physical therapists, nurses, etc.). In an example, the apparatus maybe used to help patients perform bed exercises to prevent muscle atrophy and promote faster recovery. The apparatus may be used to help patients sit up in bed and get in and out of bed without a supervising care giver have to physically assist the patient. The apparatus and methods in accordance with embodiment of the invention may relieve nurses and nursing aides from constantly having to lift patients, reducing the frequency of back injury.

In an example, the apparatus may be used to help an individual to maintain balance while walking. The apparatus may be used to provide leverage and balance while sitting down in a chair and while getting up out of the chair. In contrast to four-legged walkers, the shape of the apparatus in accordance with embodiments of the invention allows the apparatus to be easily stored near the individual without being in the way of others. For example, the apparatus may be placed around the chair in which the individual is sitting, allowing quick access.

Referring to FIG. 1, a diagram is shown illustrating a dual lever arm assist tool 100 in accordance with an embodiment of the invention. In an example, the dual lever arm assist tool 100 may be implemented as a tubular structure. In an example, the dual lever arm assist tool 100 may be implemented with one-inch diameter tubing. In an example, the dual lever arm assist tool 100 may comprise a first straight portion 102, a first curved portion 104*a*, a second curved portion 104*b*, a second straight portion 106*a*, a third straight portion 106*b*, a first lever arm 108*a*, and a second lever arm 108*b*. The first straight portion 102, the first curved portion 104*a*, the second curved portion 104*b*, the second straight portion 106*a*, and the third straight portion 106*b* generally are assembled to form a U-shaped structure (or portion) of the dual lever arm assist tool 100, the ends of which the first lever arm 108*a* and the second lever arm 108*b* are attached.

In various embodiments, a first end of the first straight portion 102 is generally connected to a first end of the first curved portion 104*a*. A second end of the first straight portion 102 is generally connected to a first end of the second curved portion 104*a*. A second end of the first curved portion 104*a* is generally connected to a first end of the second straight portion 106*a*. A second end of the second curved portion 104*b* is generally connected to a first end of the third straight portion 106*b*. In various embodiments, the first and the second curved portions 104*a* and 104*b* may have bends of approximately 90 degree. In some embodiments, the first straight portion 102, the first and the second curved portions 104*a* and 104*b*, and the second and the third straight portions 106*a* and 106*b* are implemented as a single piece. In an example, a single piece of tubing may be bent using conventional techniques to form the first straight portion 102, the first and the second curved portion 104*a* and 104*b*, and the second and the third straight portions 106*a* and 106*b*.

In some embodiments, the first straight portion 102, the first and the second curved portions 104*a* and 104*b*, and the second and the third straight portions 106*a* and 106*b* are implemented as separate pieces joined together. In one example, the portions may be joined together by reducing an outer diameter of one of the portions to fit within an inner diameter of another of the portions. The portions may be further configured such that when the portions are assembled, the portions are rigidly attached and oriented relative to one another to form the U-shaped structure. In one example, the portions may be shaped in a manner the significantly limits relative rotation when the portions are assembled (e.g., splined, keyed, etc.). In another example, the portion configured to fit inside another portion may comprise spring buttons (or tabs) while the portion configured to fit over another portion may comprise openings into which the spring buttons extend when the portions are properly aligned. In another example, the portions may be joined using existing coupling techniques (e.g., compression couplings, setscrew couplings, etc.) similar to those used to join copper plumbing and rigid metal electrical conduit. In another example, the portions may be joined by fasteners (e.g., rivets, screws, etc.).

The lever arm 108*a* is generally connected to a second end of the second straight portion 106*a*. The lever arm 108*b* is generally connected to a second end of the third straight portion 106*b*. The first straight portion 102, the first curved portion 104*a*, and the second curved portion 104*b* are generally aligned in a first plane. The first lever arm 108*a* is generally aligned in a second plane. The second lever arm 108*b* is generally aligned in a third plane. In one example, the second and the third planes are generally parallel to each other and perpendicular to the first plane. In another example, the second and the third planes are slightly angled (e.g. about 5 degrees) from being perpendicular to the first plane such that the ends of the first lever arm 108*a* and the second lever arm 108*b* proximal the first and the second curved portions 104*a* and 104*b* are closer together than the distal ends of the first lever arm 108*a* and the second lever arm 108*b* (e.g., described below in connection with FIG. 15). In an example, the assembled dual lever arm assist tool 100 may be implemented with dimensions of width of about 23 inches, a depth of about 19 inches and a height of about 36 inches. However, the individual dimensions may be varied to fit proportions of a variety of individuals or patients.

In an example, the first lever arm 108*a* may comprise a curved portion 110*a*, a straight portion 112*a*, and a bent portion 114*a*. The second lever arm 108*b* may comprise a curved portion 110*b*, a straight portion 112*b*, and a bent portion 114*b*. A first end of the straight portions 112*a* and 112*b* are connected to a first end of the curved portions 110*a* and 110*b*, respectively. A second end of the straight portions 112*a* and 112*b* are removably connected to a first end of the bent portions 114*a* and 114*b*, respectively. In an example, the curved portions 110*a* and 110*b* may have a radius of about 6 inches and may form an arc greater than 90 degrees (e.g., about 120 degrees). In an example, the bent portions 114*a* and 114*b* may have a height of about 9 inches and may have a bend equivalent to the arc of the portions 110*a* and 110*b* less 90 degrees (e.g., about 30 degrees when portions 110*a* and 110*b* have an arc of about 120 degrees). In an example, a second end of the bent portions 114*a* and 114*b* may be configured to accept a cap or pad 118. The pads 118 may be configured to provide a broader base than a tube diameter of the bent portions 114*a* and 114*b*. In an example, the caps or pads 118 may comprise a material such as nylon, rubber, modified chlorinated polyolefin (Neoprene®), or other similar material.

In some embodiments, the curved portions 110*a* and 110*b* and the straight portions 112*a* and 112*b*, respectively, are implemented as a single piece. In an example, one piece of tubing may be bent using conventional techniques to form the curved portion 110*a* and the straight portion 112*a* as a unit, and a second piece of tubing may be bent using conventional techniques to form the curved portion 110*b* and the straight portion 112*b* as a unit. In some embodiments, the curved portions 110*a* and 110*b* and the straight portions 112*a* and 112*b*, respectively, are implemented as separate pieces joined together. In one example, the portions may be joined together by reducing an outer diameter of one of the portions to fit within an inner diameter of another of the portions. The portions may be further configured such that when the portions are assembled, the portions are rigidly attached and oriented relative to one another to form the respective portion of the lever arm structure. In one example, the portions may be shaped in a manner the significantly limits relative rotation when the portions are assembled (e.g., splined, keyed, etc.). In another example, the portion configured to fit inside another portion may comprise spring buttons (or tabs) while the portion configured to fit over another portion may comprise openings into which the spring buttons (or tabs) extend when the portions are properly aligned. In another example, the portions may be joined using existing coupling techniques (e.g., compression couplings, setscrew couplings, etc.) similar to those used to join copper plumbing and rigid metal electrical conduit. In another example, the portions may be joined by fasteners (e.g., rivets, screws, etc.).

In an example, couplings 116*a* and 116*b* may be used to removably connect the second end of the straight portions 112*a* and 112*b* to the first end of the bent portions 114*a* and 114*b*, respectively. In an example, the couplings 116*a* and 116*b* may be separate from the straight portions 112*a* and 112*b* and the bent portions 114*a* and 114*b*. In another example, the couplings 116*a* and 116*b* may be part of either the straight portions 112*a* and 112*b* or the bent portions 114*a* and 114*b*. In general, the couplings 116*a* and 116*b* may be configured to allow the first and the second bent portions 114*a* and 114*b* to be rotated 180 degrees relative to the respective straight portions 112*a* and 112*b*. In an example, the couplings 116*a* and 116*b* may be implemented with bayonet-style connectors. In another example, the couplings 116*a* and 116*b* may be implemented with spring tab connectors. However, other types of connectors, which allow the bent portions 114*a* and 114*b* to be rotated 180 degrees relative to the respective straight portions 112*a* and 112*b*, may be implemented to meet design criteria of a particular implementation.

Figure 2:
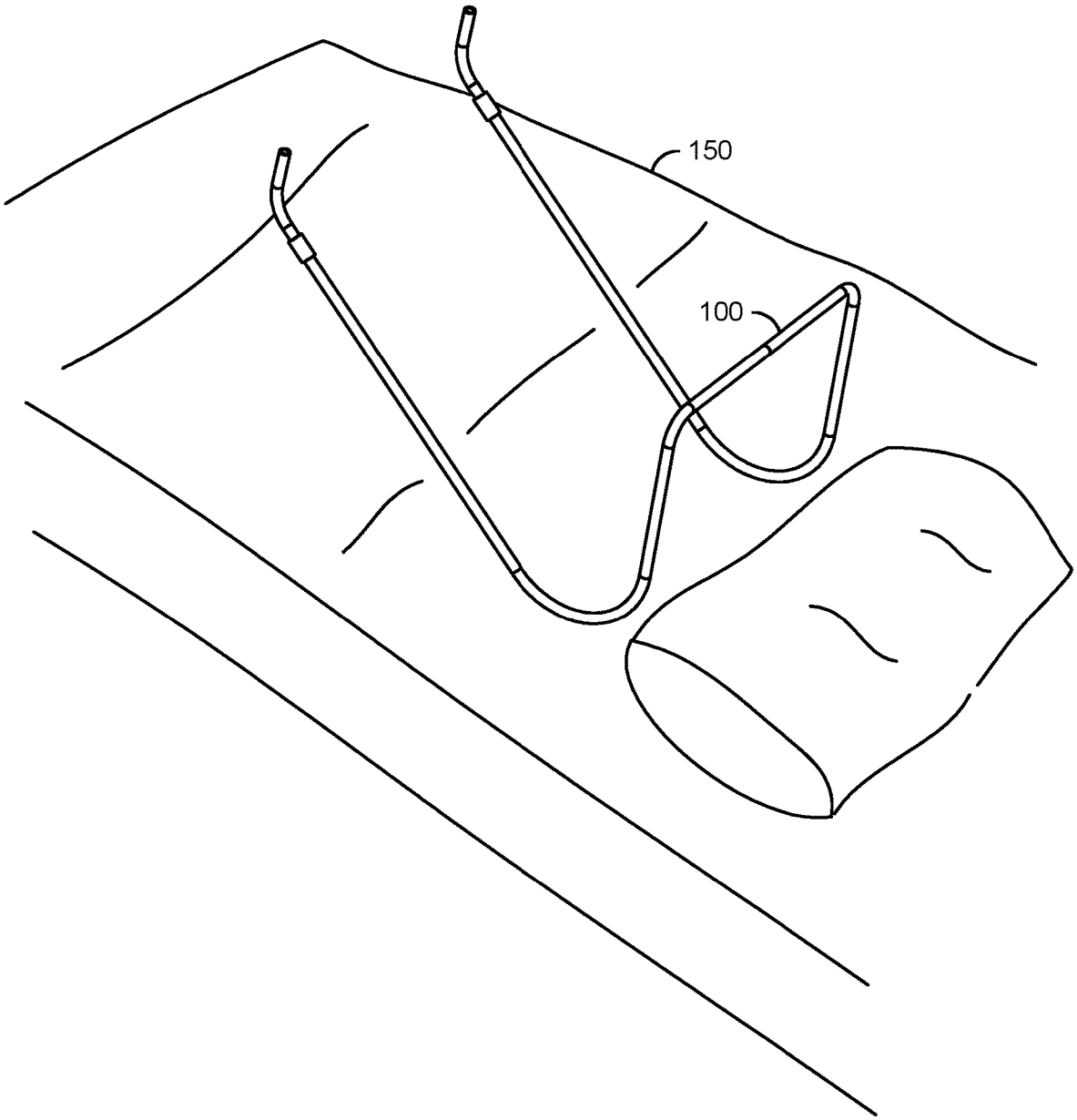
FIG. 2 is a diagram illustrating the dual lever arm assist tool on a bed in a position where a user has been lifted to a sitting position.

Referring to FIG. 2, a diagram is shown illustrating the dual lever arm assist tool 100 on a bed in a position where a user has been lifted to a sitting position. The user is omitted for clarity. In an example, the dual lever arm assist tool 100 may be placed with the U-shaped portion under the shoulders of a person lying supine in the bed 150. The person may then be assisted in rising to a seated position by applying (or having a giver apply) a force to the bent portions 114*a* and 114*b* of the two lever arms 108*a* and 108*b* of the dual lever arm assist tool 100. The bent portions 114*a* and 114*b* may be oriented as shown to allow the person to easily grab the bent portions 114*a* and 114*b* with their arms aligned to the straight portions 112*a* and 112*b*.

Figure 3:
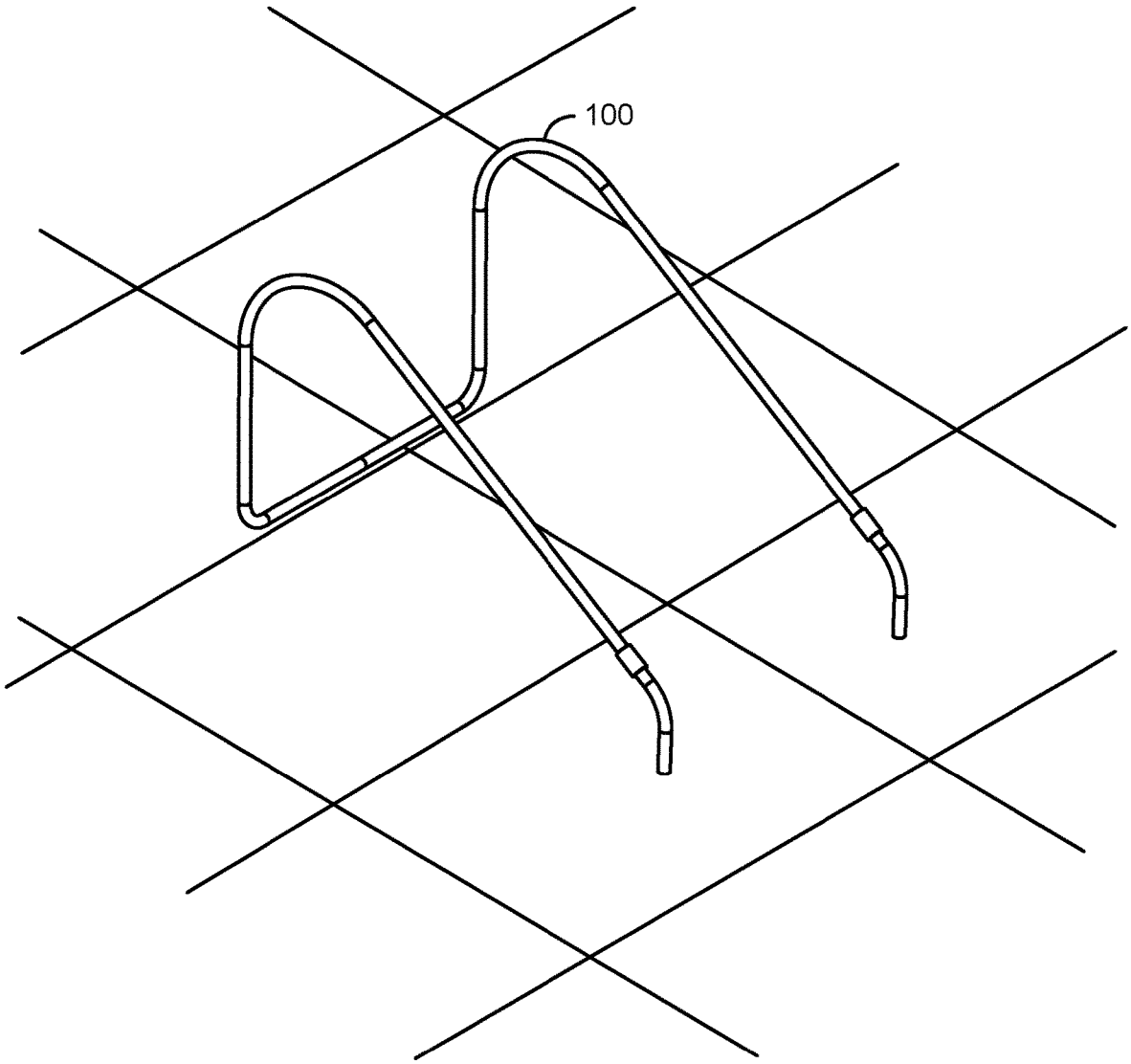
FIG. 3 is a diagram illustrating the dual lever arm assist tool on a floor in a position to assist a user into a kneeling position.

Referring to FIG. 3, a diagram is shown illustrating the dual lever arm assist tool 100 on a floor in a position to assist a user into a kneeling position. The user is omitted for clarity. When used to assist a user into a kneeling position, the bent portions 114*a* and 114*b* of the two lever arms 108*a* and 108*b* of the dual lever arm assist tool 100 are generally oriented such that the ends of bent portions 114*a* and 114*b* and the straight portion 102 of the dual lever arm assist tool 100 are in contact with the floor. This orientation generally makes a stable and strong support for assisting the user into the kneeling position.

Figure 4:
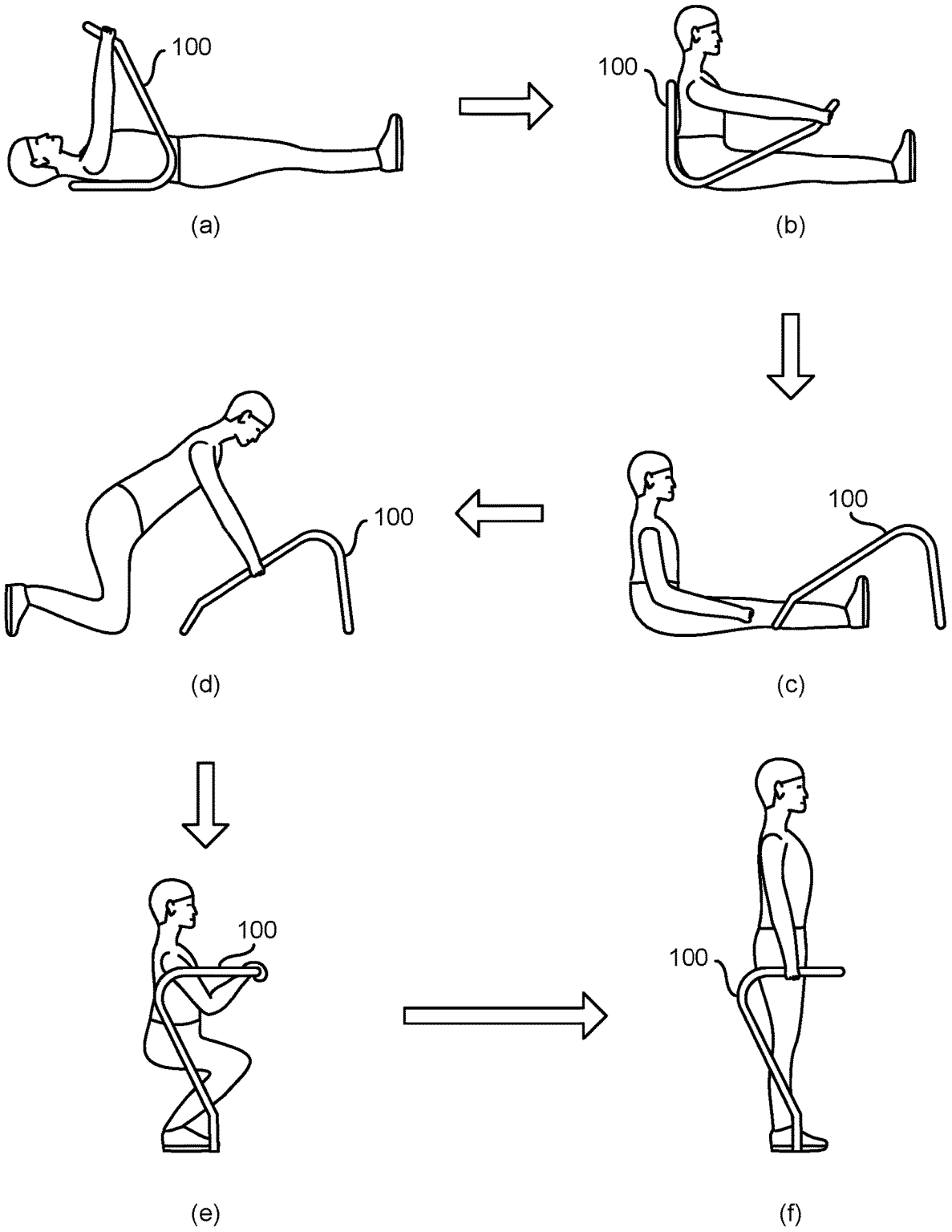
FIG. 4 is a diagram illustrating the dual lever arm assist tool being used to assist a user from a prostrate position into a standing position.

Referring to FIG. 4, a diagram is shown illustrating the dual lever arm assist tool 100 being used to assist a user from a prostrate (supine) position into a standing position. In a first step (a), the dual lever arm assist tool 100 may be placed under the head, neck, or shoulders of an individual such that the lever arms 108*a* and 108*b* of the dual lever arm assist tool 100 are adjacent to the chest of the individual. The lever arms 108*a* and 108*b* may then be rotated by the individual or another person applying a force toward the feet of the individual to at least one of the bent portions 114*a* and 114*b* until the individual is sitting up (illustrated in step (b) of FIG. 4).

Once the individual is sitting, the dual lever arm assist tool 100 may be arranged such that the U-shaped portion, the first bent portion 114*a* of the first lever arm 108*a*, and the second bent portion 114*b* of the second lever arm 108*b* are in contact with a surface on which the individual is sitting (illustrated in step (c) of FIG. 4). The dual lever arm assist tool 100 may then be used to assist the individual into a kneeling position (illustrated in step (d) of FIG. 4).

When the individual is kneeling, the dual lever arm assist tool 100 may be arranged such that the first bent portion 114*a* of the first lever arm 108*a* and the second bent portion 114*b* of the second lever arm 108*b* are rotated 180 degrees and are in contact with the surface on which the individual is kneeling, with the U-shaped portion above the first bent portion 114*a* of the first lever arm 108*a* and the second bent portion 114*b* of the second lever arm 108*b*. The dual lever arm assist tool 100 may then be used to assist the individual into a squatting position (illustrated in step (e) of FIG. 4). The dual lever arm assist tool 100 may then be used to assist the individual into a standing position (illustrated in step (f) of FIG. 4). The dual lever arm assist tool 100 may also be used to assist the individual from the standing position into the kneeling position, the sitting position, or the prostrate position by reversing the steps (a)-(f) described above.

Figure 5A:
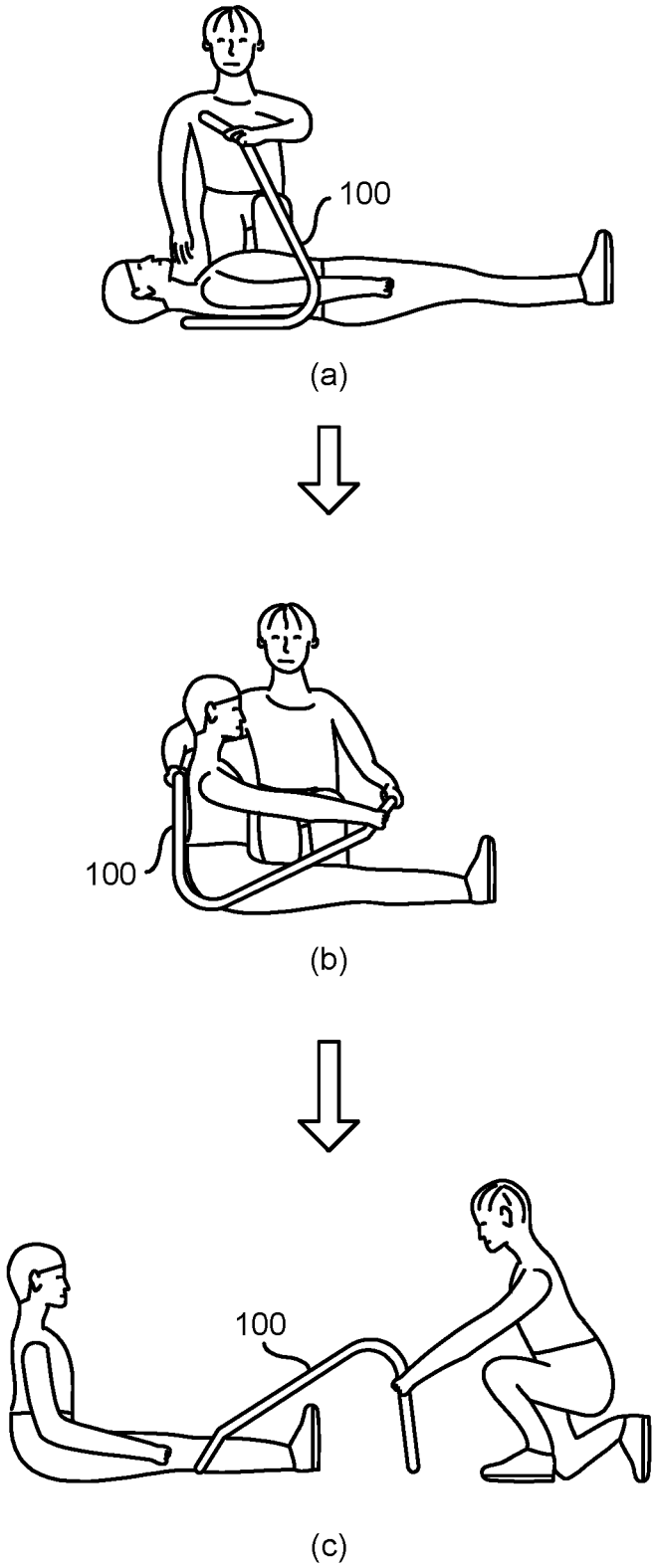
FIG. 5A is a diagram illustrating the dual lever arm assist tool being used by a care giver to assist a user from the prostrate position into a sitting position.

FIG. 5A is a diagram illustrating the dual lever arm assist tool 100 being used by a care giver to assist a user from the prostrate position (illustrated in step (a) of FIG. 5A) into the sitting position (illustrated in step (b) of FIG. 5A). The care giver may then position the dual lever arm assist tool 100 to assist the user in moving into the kneeling position (illustrated in step (c) of FIG. 5A).

Figure 5B:
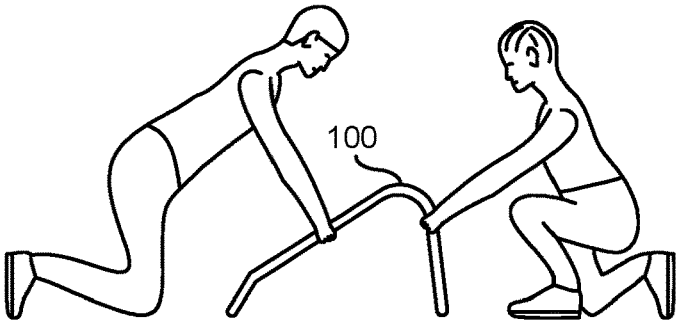
FIG. 5B is a diagram illustrating the dual lever arm assist tool being used by a care giver to assist a user from a kneeling position into the standing position.
Figure 5B:
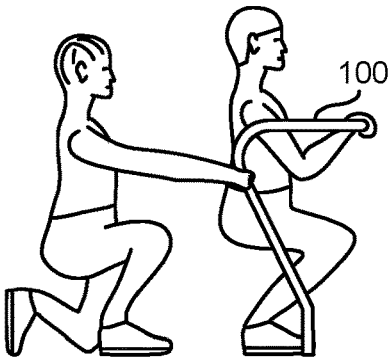
Figure 5B:
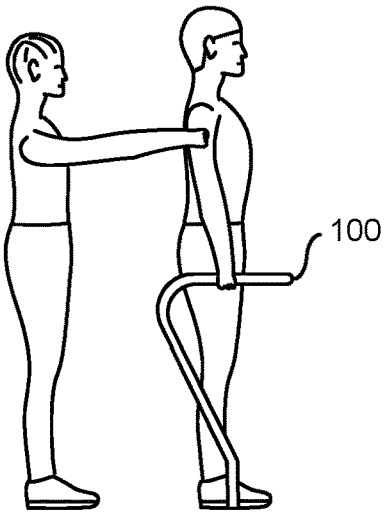

FIG. 5B is a diagram illustrating the dual lever arm assist tool 100 being used by the care giver to assist the user from the kneeling position (illustrated in step (a) of FIG. 5B) into the squatting position (illustrated in step (b) of FIG. 5B), then into the standing position (illustrated in step (c) of FIG. 5B).

Figure 6:
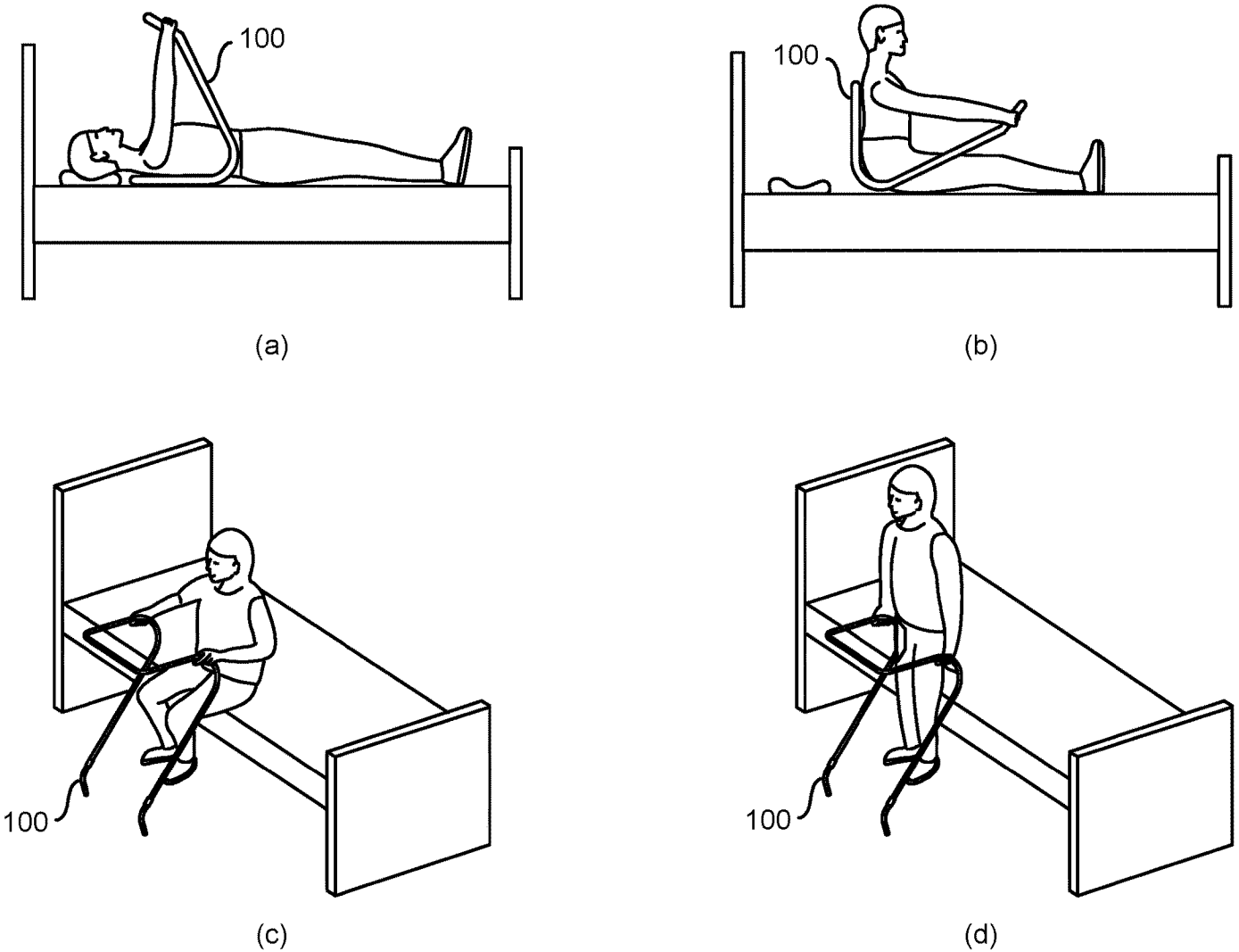
FIG. 6 is a diagram illustrating the dual lever arm assist tool being used to assist a user lying in a bed from a prostrate position into a standing position.

Referring to FIG. 6, a diagram is shown illustrating the dual lever arm assist tool 100 being used in a number of steps (a)-(d) to assist a user lying in a bed to move from a prostrate (supine) position into a standing position. In an example, the maneuver illustrated in steps (c) and (d) may also be used by a person getting out of a wheelchair. With the wheel locks on, the wheelchair may provide support similar to the bed for the person to push against while steadying themselves with dual lever arm assist tool 100. In the application illustrated in FIG. 6, the first bent portion 114*a* of the first lever arm 108*a* and the second bent portion 114*b* of the second lever arm 108*b* are rotated 180 degrees between use in rising from the supine position use in rising to the standing position.

Figure 7:
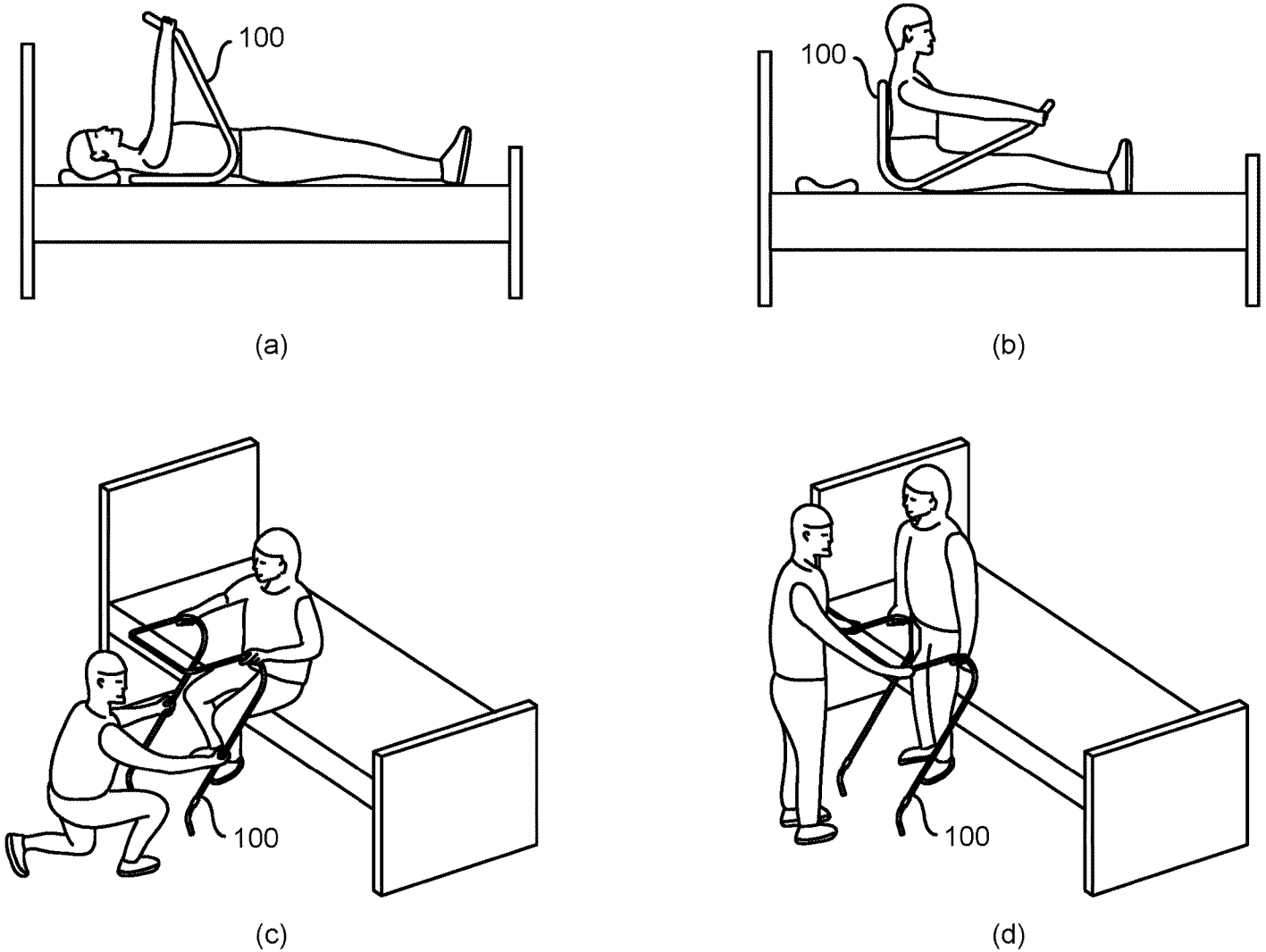
FIG. 7 is a diagram illustrating the dual lever arm assist tool being used by a care giver to assist a user from a sitting position in a bed into the standing position next to the bed.

Referring to FIG. 7, a diagram illustrating the dual lever arm assist tool 100 being used by a care giver in a number of steps (a)-(d) to assist the user to move from the sitting position at an edge of the bed into the standing position next to the bed. Although not shown, the care giver could also assist the user in sitting up in the bed.

Figure 8:
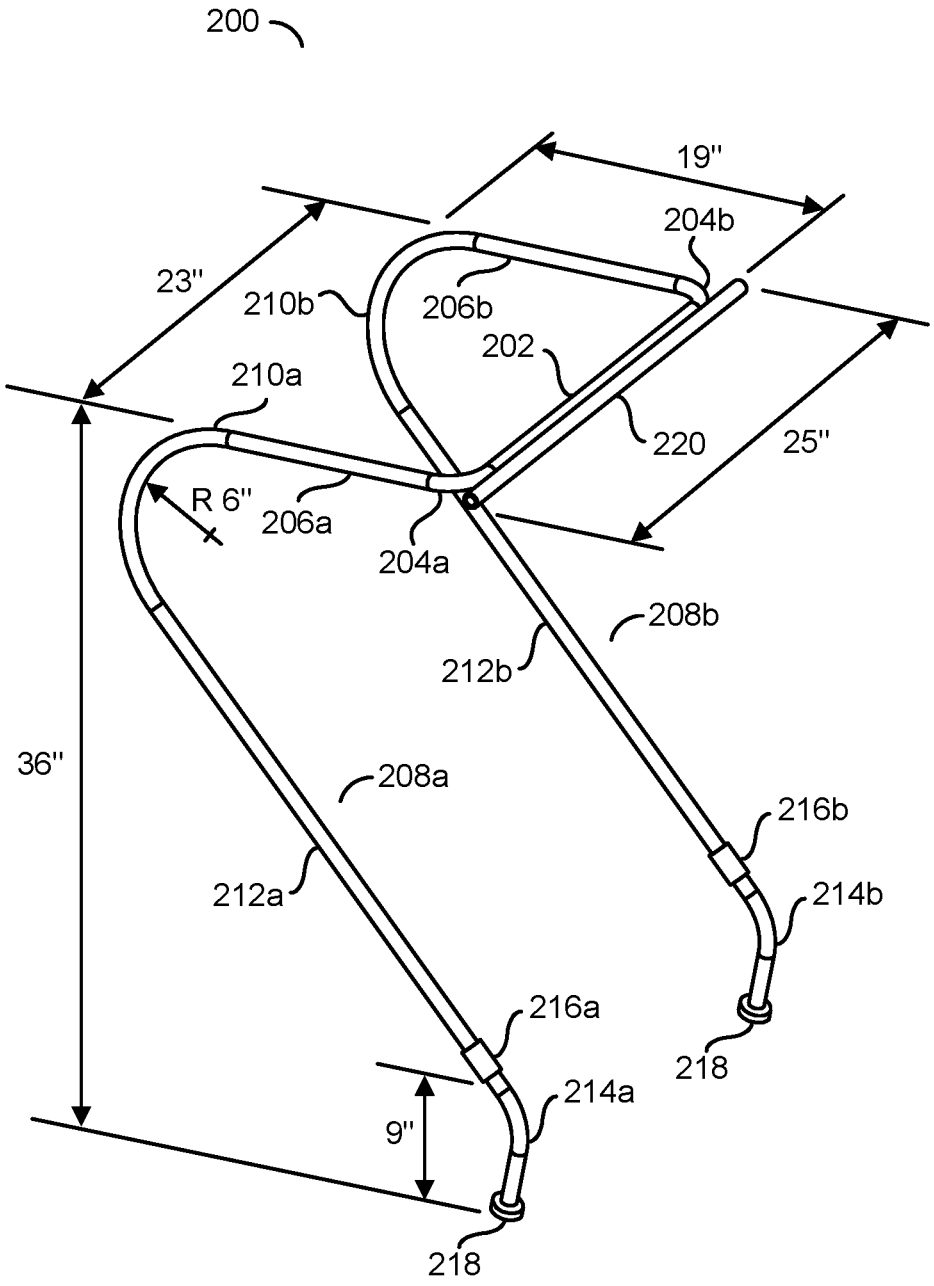
FIG. 8 is a diagram illustrating a variation of the dual lever arm assist tool in accordance with another embodiment of the invention.

Referring to FIG. 8, a diagram is shown illustrating a variation of the dual lever arm assist tool in accordance with another embodiment of the invention. In an example, a dual lever arm assist tool 200 may be implemented as a tubular structure. In an example, the dual lever arm assist tool 200 may be implemented similarly to the dual lever arm assist tool 100, except that an additional straight portion is added parallel to the straight portion 102 of the U-shaped portion to provide additional stability and additional handles for first responders and care givers.

In an example, the dual lever arm assist tool 200 may be implemented with one-inch diameter tubing. In an example, the dual lever arm assist tool 200 may comprise a first straight portion 202, a first curved portion 204*a*, a second curved portion 204*b*, a second straight portion 206*a*, a third straight portion 206*b*, a first lever arm 208*a*, and a second lever arm 208*b*. In an example, the first lever arm 208*a* may comprise a third curved portion 210*a*, a fourth straight portion 212*a*, and a first bent portion 214*a*. The second lever arm 208*b* may comprise a fourth curved portion 210*b*, a fifth straight portion 212*b*, and a second bent portion 214*b*. A sixth straight portion 220 maybe attached parallel to the first straight portion 202. The sixth straight portion 220 generally has ends that extend outward from the U-shaped portion of the dual lever arm assist tool 200 to provide the additional stability and the additional handles for the first responders and/or the care givers. The first straight portion 202, the first curved portion 204*a*, the second curved portion 204*b*, the second straight portion 206*a*, and the third straight portion 206*b* generally are assembled to form a U-shaped structure (or portion) of the dual lever arm assist tool 200, the ends of which the first lever arm 208*a* and the second lever arm 208*b* are attached.

In various embodiments, a first end of the first straight portion 202 is generally connected to a first end of the first curved portion 204*a*. A second end of the first straight portion 202 is generally connected to a first end of the second curved portion 204*a*. A second end of the first curved portion 204*a* is generally connected to a first end of the second straight portion 206*a*. A second end of the second curved portion 204*b* is generally connected to a first end of the third straight portion 206*b*. In various embodiments, the first and the second curved portions 204*a* and 204*b* may have bends of approximately 90 degree. In some embodiments, the first straight portion 202, the first and the second curved portions 204*a* and 204*b*, and the second and the third straight portions 206*a* and 206*b* are implemented as a single piece. In an example, a single piece of tubing may be bent using conventional techniques to form the first straight portion 202, the first and the second curved portion 204*a* and 204*b*, and the second and the third straight portions 206*a* and 206*b*.

In some embodiments, the first straight portion 202, the first and the second curved portion 204*a* and 204*b*, and the second and the third straight portions 206*a* and 206*b* are implemented as separate pieces joined together. In one example, the portions may be joined together by reducing an outer diameter of one of the portions to fit within an inner diameter of another of the portions. The portions may be further configured such that when the portions are assembled, the portions are rigidly attached and oriented relative to one another to form the U-shaped structure. In one example, the portions may be shaped in a manner the significantly limits relative rotation when the portions are assembled (e.g., splined, keyed, etc.). In another example, the portion configured to fit inside another portion may comprise spring buttons while the portion configured to fit over another portion may comprise openings into which the spring buttons extend when the portions are properly aligned. In another example, the portions may be joined using existing coupling techniques (e.g., compression couplings, setscrew couplings, etc.) similar to those used to join copper plumbing and rigid metal electrical conduit. In another example, the portions may be joined by fasteners (e.g., rivets, screws, etc.).

The lever arm 208*a* is generally connected to a second end of the second straight portion 206*a*. The lever arm 208*b* is generally connected to a second end of the third straight portion 206*b*. The first straight portion 202, the first curved portion 204*a*, and the second curved portion 204*b* are generally aligned in a first plane. The first lever arm 208*a* is generally aligned in a second plane. The second lever arm 208*b* is generally aligned in a third plane. In one example, the second and the third planes are generally parallel to each other and perpendicular to the first plane. In another example, the second and the third planes are slightly angled (e.g. about 5 degrees) from being perpendicular to the first plane such that the ends of the first lever arm 208*a* and the second lever arm 208*b* proximal the first and the second curved portions 204*a* and 204*b* are closer together than the distal ends of the first lever arm 208*a* and the second lever arm 208*b* (e.g., described below in connection with FIG. 15). In an example, the assembled dual lever arm assist tool 200 may be implemented with dimensions including a width of about 23 inches, a depth of about 29 inches, and a height of about 36 inches. In an example, the straight portion 220 may be implemented with a length of about 25 inches. However, the individual dimensions may be varied to fit proportions of a variety of individuals or patients.

A first end of the straight portions 212*a* and 212*b* are connected to a first end of the curved portions 210*a* and 210*b*, respectively. A second end of the straight portions 212*a* and 212*b* are removably connected to a first end of the bent portions 214*a* and 214*b*, respectively. In an example, the curved portions 210*a* and 210*b* may have a radius of about 6 inches and may form an arc greater than 90 degrees (e.g., about 120 degrees). In an example, the bent portions 214*a* and 214*b* may have a height of about 9 inches and may have a bend equivalent to the arc of the portions 210*a* and 210*b* less 90 degrees (e.g., about 30 degrees when portions 210*a* and 210*b* have an arc of about 120 degrees). In an example, a second end of the bent portions 214*a* and 214*b* may be configured to accept a cap or pad 218. The pads 218 may be configured to provide a broader base than a tube diameter of the bent portions 214*a* and 214*b*. In an example, the caps or pads 218 may comprise a material such as nylon or rubber, modified chlorinated polyolefin (Neoprene®), or other similar material.

In some embodiments, the curved portions 210*a* and 210*b* and the straight portions 212*a* and 212*b*, respectively, are implemented as a single piece. In an example, one piece of tubing may be bent using conventional techniques to form the curved portion 210*a* and the straight portion 212*a* as a unit, and a second piece of tubing may be bent using conventional techniques to form the curved portion 210*b* and the straight portion 212*b* as a unit. In some embodiments, the curved portions 210*a* and 210*b* and the straight portions 212*a* and 212*b*, respectively, are implemented as separate pieces joined together. In one example, the portions may be joined together by reducing an outer diameter of one of the portions to fit within an inner diameter of another of the portions. The portions may be further configured such that when the portions are assembled, the portions are rigidly attached and oriented relative to one another to form the respective portion of the lever arm structure. In one example, the portions may be shaped in a manner the significantly limits relative rotation when the portions are assembled (e.g., splined, keyed, etc.). In another example, the portion configured to fit inside another portion may comprise spring buttons while the portion configured to fit over another portion may comprise openings into which the spring buttons extend when the portions are properly aligned. In another example, the portions may be joined using existing coupling techniques (e.g., compression couplings, setscrew couplings, etc.) similar to those used to join copper plumbing and rigid metal electrical conduit. In another example, the portions may be joined by fasteners (e.g., rivets, screws, etc.).

In an example, couplings 216*a* and 216*b* may be used to removably connect the second end of the straight portions 212*a* and 212*b* to the first end of the bent portions 214*a* and 214*b*, respectively. In an example, the couplings 216*a* and 216*b* may be separate from the straight portions 212*a* and 212*b* and the bent portions 214*a* and 214*b*. In another example, the couplings 216*a* and 216*b* may be part of either the straight portions 212*a* and 212*b* or the bent portions 214*a* and 214*b*. In general, the couplings 216*a* and 216*b* may be configured to allow the first and the second bent portions 214*a* and 214*b* to be rotated 180 degrees relative to the respective straight portions 212*a* and 212*b*. In an example, the couplings 216*a* and 216*b* may be implemented with bayonet-style connectors. In another example, the couplings 216*a* and 216*b* may be implemented with spring tab connectors. However, other types of connectors, which allow the bent portions 214*a* and 214*b* to be rotated 180 degrees relative to the respective straight portions 212*a* and 212*b*, may be implemented to meet design criteria of a particular implementation.

Figure 9:
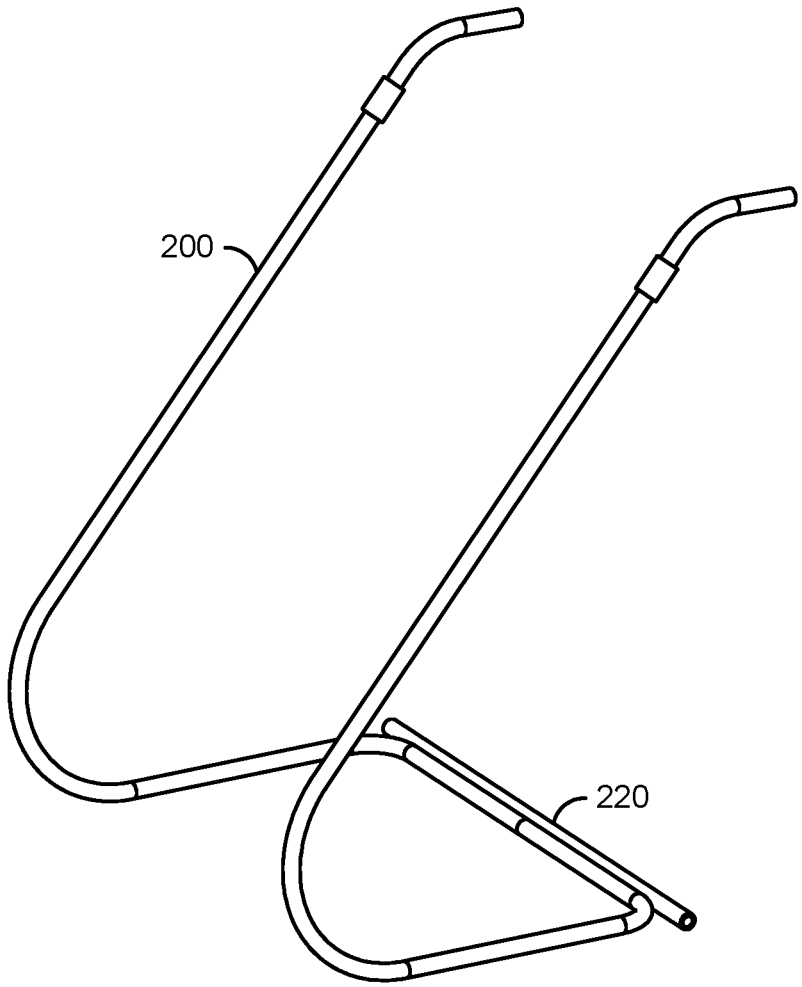
FIG. 9 is a diagram illustrating the dual lever arm assist tool of FIG. 8 in a position for assisting a user into a sitting position.

Referring to FIG. 9, a diagram is shown illustrating the dual lever arm assist tool 200 of FIG. 8 in a position for assisting a user to move from a position lying supine into a sitting position. The user is omitted for clarity. In an example, the dual lever arm assist tool 200 may be placed with the U-shaped portion under the shoulders of a person lying supine. The person may then be assisted in rising to a seated position by applying (or having a care giver apply) a force to the bent portions 214*a* and 214*b* of the two lever arms 208*a* and 208*b* of the dual lever arm assist tool 200. The bent portions 214*a* and 214*b* may be oriented as shown to allow the person to easily grab the bent portions 214*a* and 214*b* with their arms aligned to the straight portions 212*a* and 212*b*.

Figure 10:
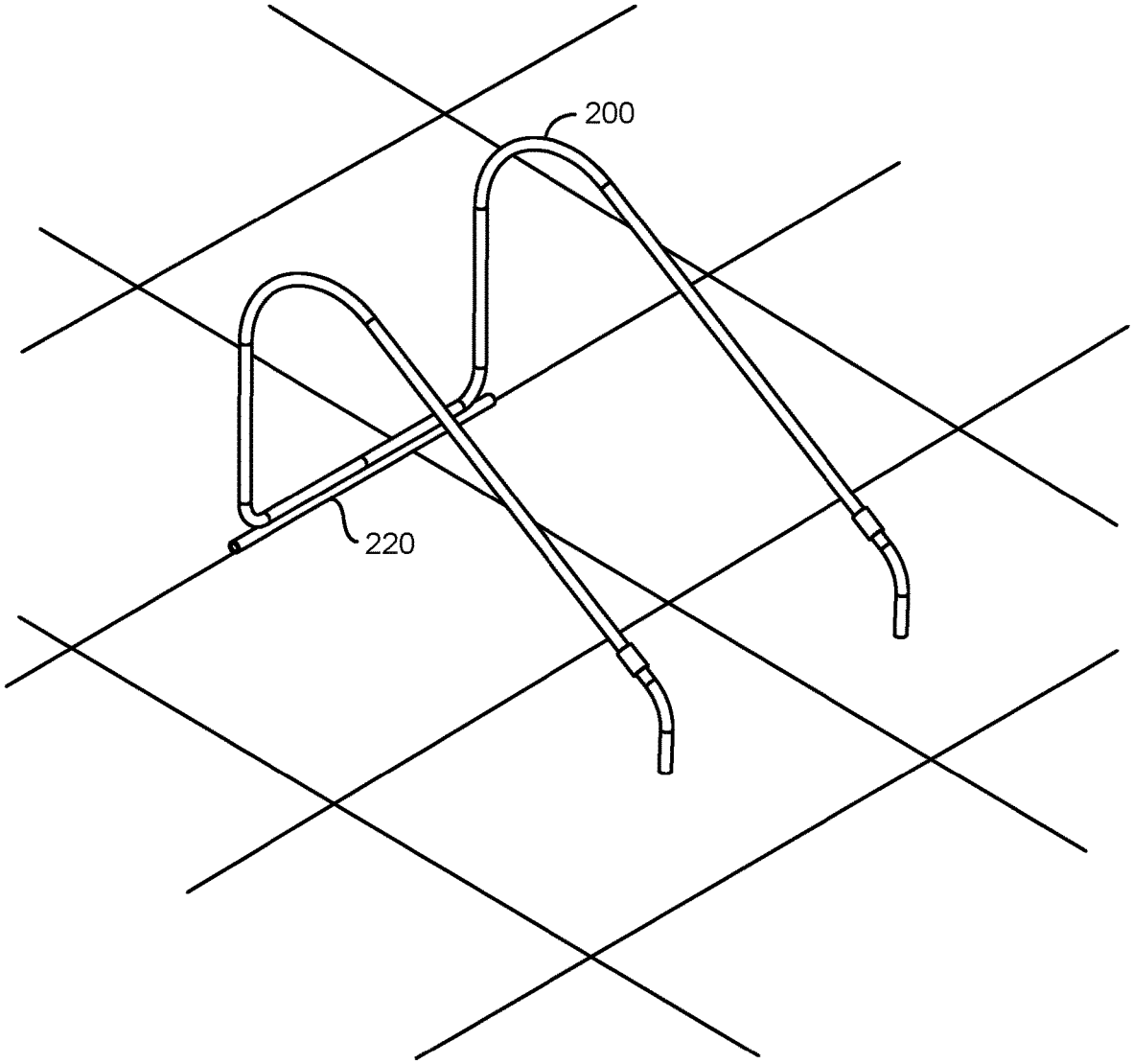
FIG. 10 is a diagram illustrating the dual lever arm assist tool of FIG. 8 on a floor in a position to assist a user into a kneeling position.

Referring to FIG. 10, a diagram is shown illustrating the dual lever arm assist tool 200 of FIG. 8 on a floor in a position to assist a user into a kneeling position. The user is omitted for clarity. When used to assist a user into a kneeling position, the bent portions 214*a* and 214*b* of the two lever arms 208*a* and 208*b* of the dual lever arm assist tool 200 are generally oriented such that the ends of bent portions 214*a* and 214*b* and the straight portion 202 of the dual lever arm assist tool 200 are in contact with the floor. This orientation generally makes a stable and strong support for assisting the user into the kneeling position.

Figure 11:
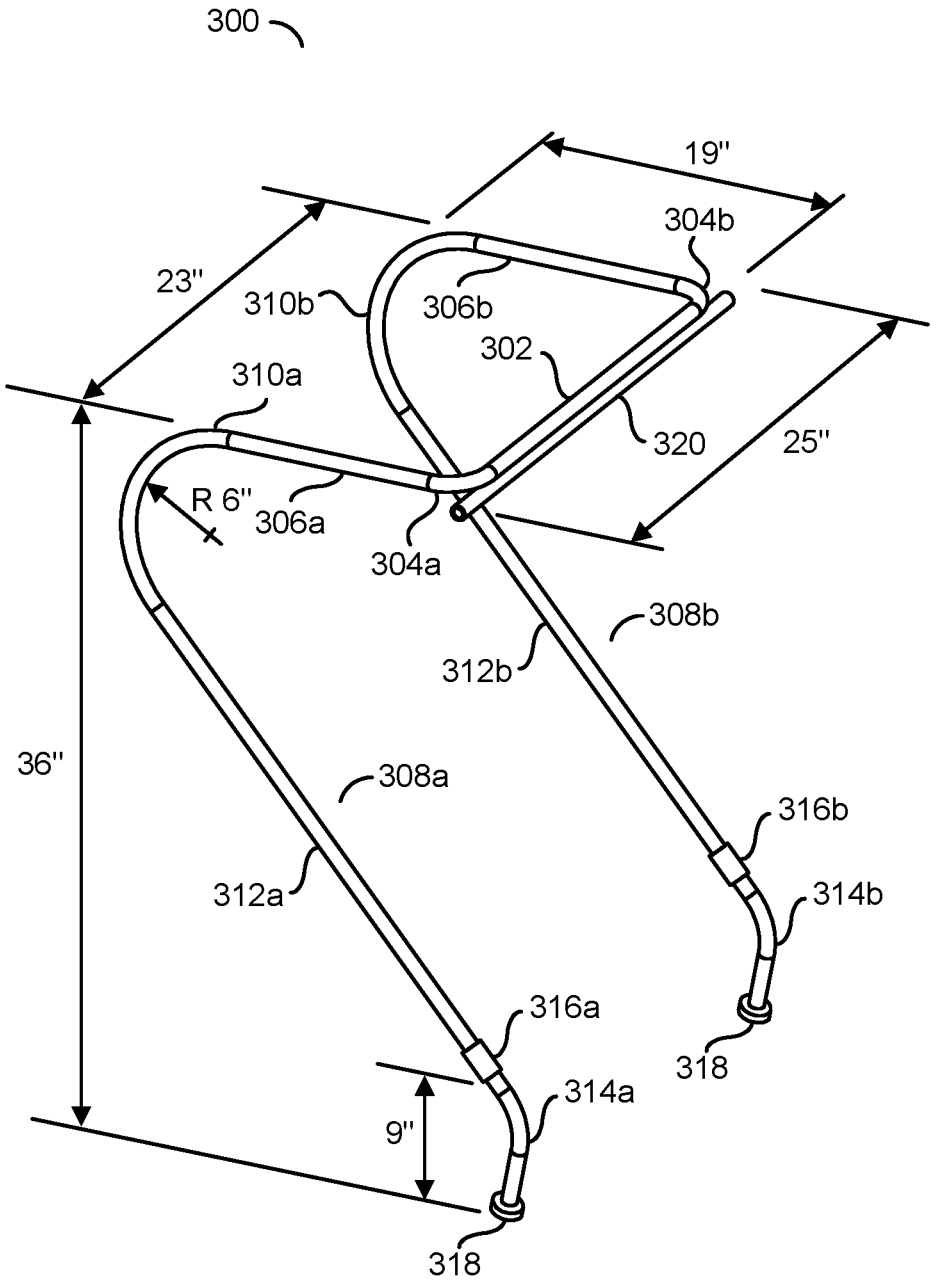
FIG. 11 is a diagram illustrating another variation of the dual lever arm assist tool in accordance with still another embodiment of the invention.

Referring to FIG. 11, a diagram is shown illustrating another variation of the dual lever arm assist tool in accordance with still another embodiment of the invention. In an example, a dual lever arm assist tool 300 may be implemented as a tubular structure. In an example, the dual lever arm assist tool 300 may be implemented similarly to the dual lever arm assist tool 300, except that the additional straight portion is added to a position on the U-shaped portion that is 90 degrees from the straight portion 220 of the dual lever arm assist tool 200.

In an example, the dual lever arm assist tool 300 may be implemented with one-inch diameter tubing. In an example, the dual lever arm assist tool 300 may comprise a first straight portion 302, a first curved portion 304*a*, a second curved portion 304*b*, a second straight portion 306*a*, a third straight portion 306*b*, a first lever arm 308*a*, and a second lever arm 308*b*. In an example, the first lever arm 308*a* may comprise a third curved portion 310*a*, a fourth straight portion 312*a*, and a first bent portion 314*a*. The second lever arm 308*b* may comprise a fourth curved portion 310*b*, a fifth straight portion 312*b*, and a second bent portion 314*b*. A sixth straight portion 320 maybe attached parallel to the first straight portion 302. The sixth straight portion 320 generally has ends that extend outward from the U-shaped portion of the dual lever arm assist tool 300 to provide the additional stability and the additional handles for the first responders and/or the care givers. The first straight portion 302, the first curved portion 304*a*, the second curved portion 304*b*, the second straight portion 306*a*, and the third straight portion 306*b* generally are assembled to form a U-shaped structure (or portion) of the dual lever arm assist tool 300, the ends of which the first lever arm 308*a* and the second lever arm 308*b* are attached.

In various embodiment, a first end of the first straight portion 302 is generally connected to a first end of the first curved portion 304*a*. A second end of the first straight portion 302 is generally connected to a first end of the second curved portion 304*a*. A second end of the first curved portion 304*a* is generally connected to a first end of the second straight portion 306*a*. A second end of the second curved portion 304*b* is generally connected to a first end of the third straight portion 306*b*. In various embodiments, the first and the second curved portions 304*a* and 304*b* may have bends of approximately 90 degree. In some embodiments, the first straight portion 302, the first and the second curved portions 304*a* and 304*b*, and the second and the third straight portions 306*a* and 306*b* are implemented as a single piece. In an example, a single piece of tubing may be bent using conventional techniques to form the first straight portion 302, the first and the second curved portion 304*a* and 304*b*, and the second and the third straight portions 306*a* and 306*b*.

In some embodiments, the first straight portion 302, the first and the second curved portion 304*a* and 304*b*, and the second and the third straight portions 306*a* and 306*b* are implemented as separate pieces joined together. In one example, the portions may be joined together by reducing an outer diameter of one of the portions to fit within an inner diameter of another of the portions. The portions may be further configured such that when the portions are assembled, the portions are rigidly attached and oriented relative to one another to form the U-shaped structure. In one example, the portions may be shaped in a manner the significantly limits relative rotation when the portions are assembled (e.g., splined, keyed, etc.). In another example, the portion configured to fit inside another portion may comprise spring buttons while the portion configured to fit over another portion may comprise openings into which the spring buttons extend when the portions are properly aligned. In another example, the portions may be joined using existing coupling techniques (e.g., compression couplings, setscrew couplings, etc.) similar to those used to join copper plumbing and rigid metal electrical conduit. In another example, the portions may be joined by fasteners (e.g., rivets, screws, etc.).

The lever arm 308*a* is generally connected to a second end of the second straight portion 306*a*. The lever arm 308*b* is generally connected to a second end of the third straight portion 306*b*. The first straight portion 302, the first curved portion 304*a*, and the second curved portion 304*b* are generally aligned in a first plane. The first lever arm 308*a* is generally aligned in a second plane. The second lever arm 308*b* is generally aligned in a third plane. In one example, the second and the third planes are generally parallel to each other and perpendicular to the first plane. In another example, the second and the third planes are slightly angled (e.g. about 5 degrees) from being perpendicular to the first plane such that the ends of the first lever arm 308*a* and the second lever arm 308*b* proximal the first and the second curved portions 304*a* and 304*b* are closer together than the distal ends of the first lever arm 308*a* and the second lever arm 308*b* (e.g., described below in connection with FIG. 15). In an example, the assembled dual lever arm assist tool 300 may be implemented with dimensions including a width of about 23 inches, a depth of about 29 inches, and a height of about 36 inches. In an example, the straight portion 320 may be implemented with a length of about 25 inches. However, the individual dimensions may be varied to fit proportions of a variety of individuals or patients.

A first end of the straight portions 312*a* and 312*b* are connected to a first end of the curved portions 310*a* and 310*b*, respectively. A second end of the straight portions 312*a* and 312*b* are removably connected to a first end of the bent portions 314*a* and 314*b*, respectively. In an example, the curved portions 310*a* and 310*b* may have a radius of about 6 inches and may form an arc greater than 90 degrees (e.g., about 120 degrees). In an example, the bent portions 314*a* and 314*b* may have a height of about 9 inches and may have a bend equivalent to the arc of the portions 310*a* and 310*b* less 90 degrees (e.g., about 30 degrees when portions 310*a* and 310*b* have an arc of about 120 degrees). In an example, a second end of the bent portions 314*a* and 314*b* may be configured to accept a cap or pad 318. The pads 318 may be configured to provide a broader base than a tube diameter of the bent portions 314*a* and 314*b*. In an example, the caps or pads 318 may comprise a material such as nylon or rubber, modified chlorinated polyolefin (Neoprene®), or other similar material.

In some embodiments, the curved portions 310*a* and 310*b* and the straight portions 312*a* and 312*b*, respectively, are implemented as a single piece. In an example, one piece of tubing may be bent using conventional techniques to form the curved portion 310*a* and the straight portion 312*a* as a unit, and a second piece of tubing may be bent using conventional techniques to form the curved portion 310*b* and the straight portion 312*b* as a unit. In some embodiments, the curved portions 310*a* and 310*b* and the straight portions 312*a* and 312*b*, respectively, are implemented as separate pieces joined together. In one example, the portions may be joined together by reducing an outer diameter of one of the portions to fit within an inner diameter of another of the portions. The portions may be further configured such that when the portions are assembled, the portions are rigidly attached and oriented relative to one another to form the respective portion of the lever arm structure. In one example, the portions may be shaped in a manner the significantly limits relative rotation when the portions are assembled (e.g., splined, keyed, etc.). In another example, the portion configured to fit inside another portion may comprise spring buttons while the portion configured to fit over another portion may comprise openings into which the spring buttons extend when the portions are properly aligned. In another example, the portions may be joined using existing coupling techniques (e.g., compression couplings, setscrew couplings, etc.) similar to those used to join copper plumbing and rigid metal electrical conduit. In another example, the portions may be joined by fasteners (e.g., rivets, screws, etc.).

In an example, couplings 316*a* and 316*b* may be used to removably connect the second end of the straight portions 312*a* and 312*b* to the first end of the bent portions 314*a* and 314*b*, respectively. In an example, the couplings 316*a* and 316*b* may be separate from the straight portions 312*a* and 312*b* and the bent portions 314*a* and 314*b*. In another example, the couplings 316*a* and 316*b* may be part of either the straight portions 312*a* and 312*b* or the bent portions 314*a* and 314*b*. In general, the couplings 316*a* and 316*b* may be configured to allow the first and the second bent portions 314*a* and 314*b* to be rotated 180 degrees relative to the respective straight portions 312*a* and 312*b*. In an example, the couplings 316*a* and 316*b* may be implemented with bayonet-style connectors. In another example, the couplings 316*a* and 316*b* may be implemented with spring tab connectors. However, other types of connectors, which allow the bent portions 314*a* and 314*b* to be rotated 180 degrees relative to the respective straight portions 312*a* and 312*b*, may be implemented to meet design criteria of a particular implementation.

Figure 12:
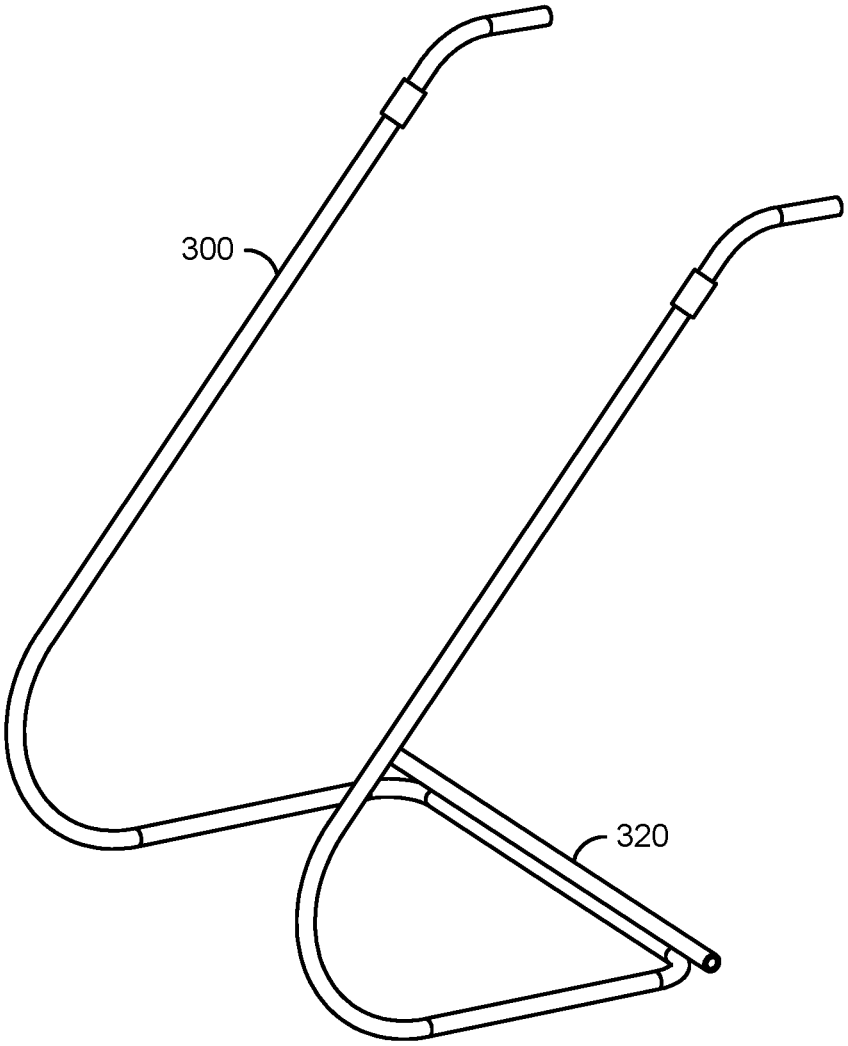
FIG. 12 is a diagram illustrating the dual lever arm assist tool of FIG. 11 in a position for assisting a user into a sitting position.

Referring to FIG. 12, a diagram is shown illustrating the dual lever arm assist tool 300 of FIG. 11 in a position for assisting a user to move from a position lying supine into a sitting position. The user is omitted for clarity. In an example, the dual lever arm assist tool 300 may be placed with the U-shaped portion under the shoulders of a person lying supine. The person may then be assisted in rising to a seated position by applying (or having a care giver apply) a force to the bent portions 314*a* and 314*b* of the two lever arms 308*a* and 308*b* of the dual lever arm assist tool 300. The bent portions 314*a* and 314*b* may be oriented as shown to allow the person to easily grab the bent portions 314*a* and 314*b* with their arms aligned to the straight portions 312*a* and 312*b*.

Figure 13:
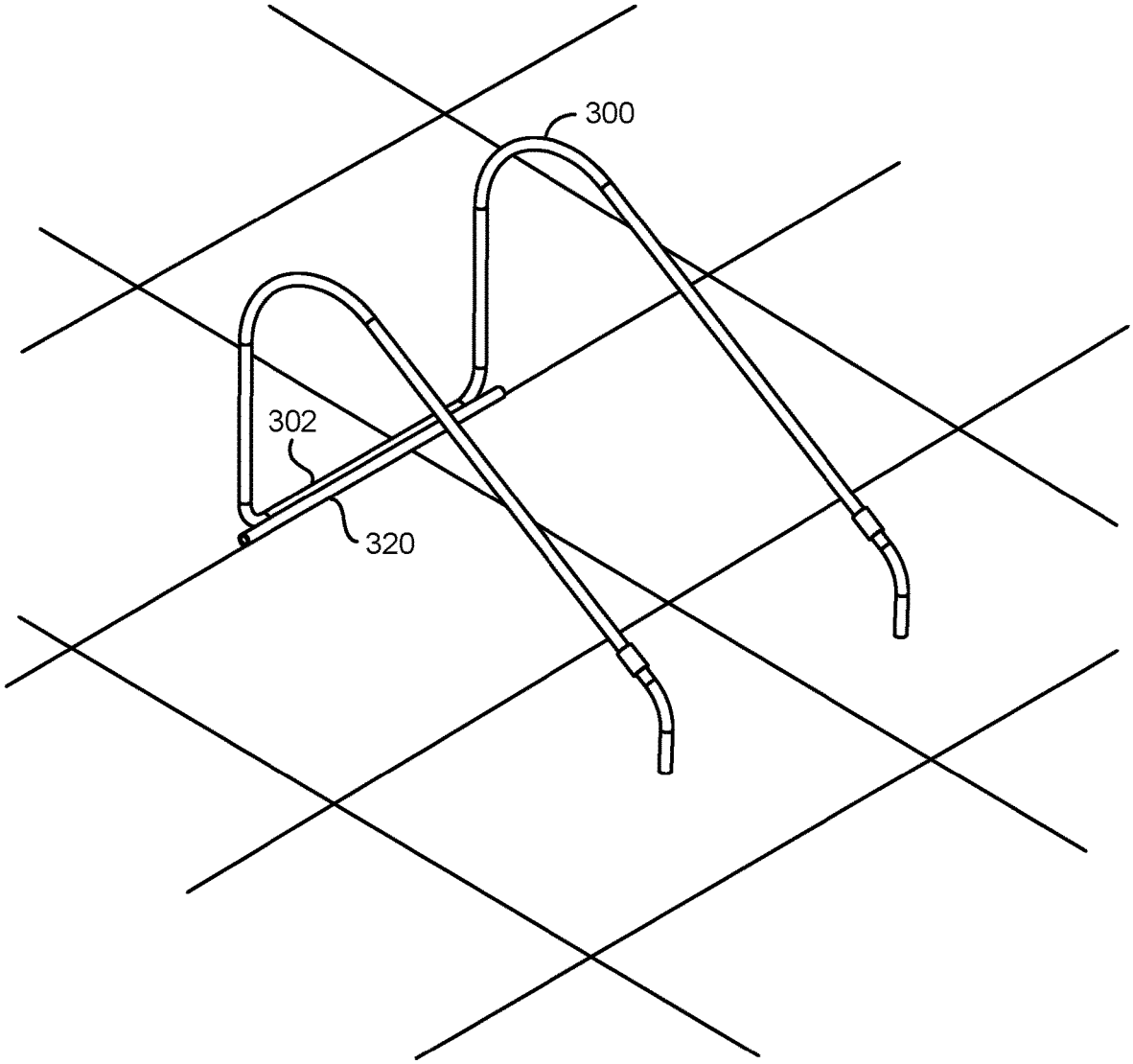
FIG. 13 is a diagram illustrating the dual lever arm assist tool of FIG. 11 on a floor in a position to assist a user into a kneeling position.

Referring to FIG. 13, a diagram is shown illustrating the dual lever arm assist tool 300 of FIG. 11 on a floor in a position to assist a user into a kneeling position. The user is omitted for clarity. When used to assist a user into a kneeling position, the bent portions 314*a* and 314*b* of the two lever arms 108*a* and 108*b* of the dual lever arm assist tool 300 are generally oriented such that the ends of bent portions 314*a* and 314*b* and the straight portion 302 of the dual lever arm assist tool 300 are in contact with the floor. This orientation generally makes a stable and strong support for assisting the user into the kneeling position.

Figure 14:
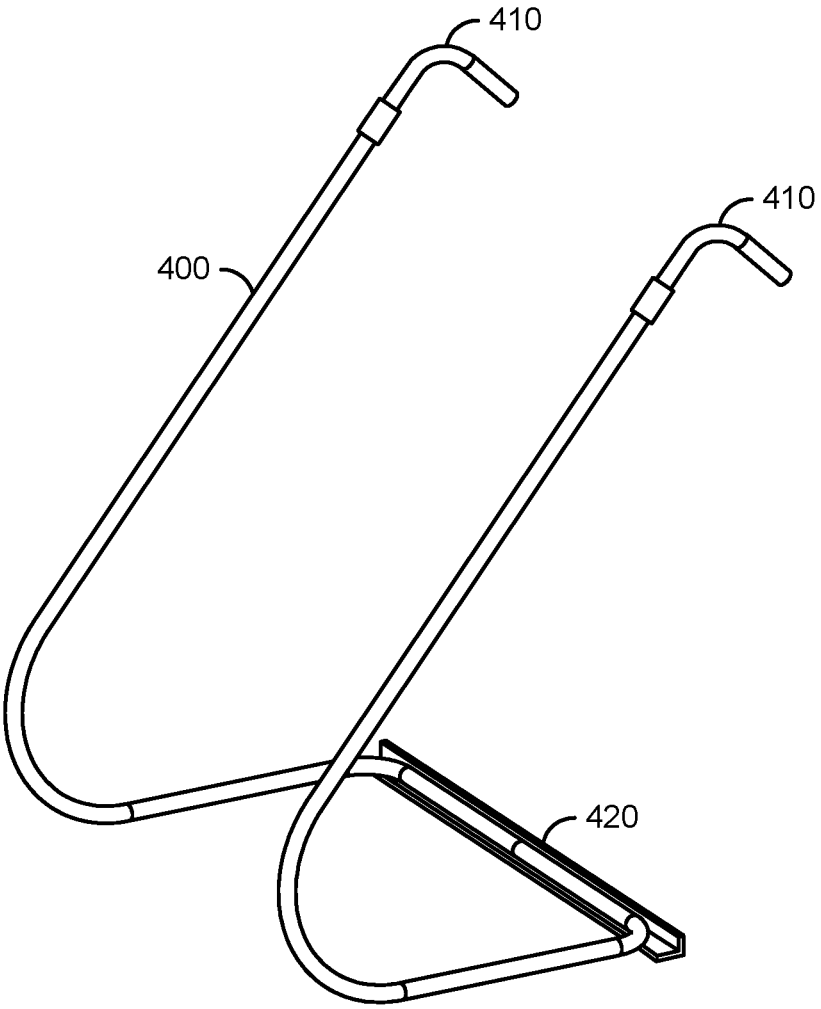
FIG. 14 is a diagram illustrating another variation of the dual lever arm assist tool in accordance with still another embodiment of the invention.

Referring to FIG. 14, a diagram is shown illustrating another variation of the dual lever arm assist tool in accordance with still another embodiment of the invention. In an example, a dual lever arm assist tool 400 may be implemented as a tubular structure. In an example, the dual lever arm assist tool 400 may be implemented similarly to the dual lever arm assist tool 100, except that a pair of bent portions 410 replace the bent portions 114*a* and 114*b*, and a straight angle-iron portion 420 is attached to a position on the U-shaped portion. The bent portions 410 have a bend that is approximately ninety degrees. The ninety degree bend generally increases an amount of leverage provided by the dual lever arm assist tool 400 in helping a user into the sitting position. In an example, the section of angle-iron generally provides enhanced stability when the U-shaped portion is in contact with a flat surface (e.g., a floor, pavement, etc.). In an example, the angle-iron portion 420 may provide improved stability by preventing the dual lever arm assist tool 400 from rolling to one side when an uneven (or unbalanced) pressure is applied to the two lever arm portions.

Figure 15:
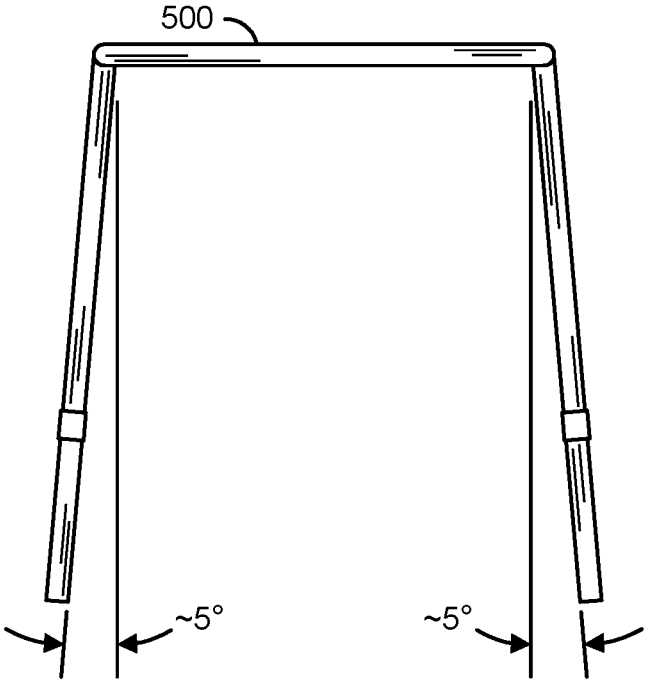
FIG. 15 is a diagram illustrating another variation of the dual lever arm assist tool in accordance with still another embodiment of the invention.

Referring to FIG. 15, a diagram is shown illustrating another variation of the dual lever arm assist tool in accordance with still another embodiment of the invention. In an example, a dual lever arm assist tool 500 may be implemented as a tubular structure. In an example, the dual lever arm assist tool 500 may be implemented similarly to any of the dual lever arm assist tools 100, 200, and 300, except that the lever arms 108*a* and 108*b*, 208*a* and 208*b*, and 308*a* and 308*b* are slightly angled (e.g. about 5 degrees) from being perpendicular to the U-shaped portions 102, 202, 302, respectively, such that the ends of the first lever arm and the second lever arm proximal the U-shaped potion are closer together than the distal ends of the lever arms.

Figure 16:
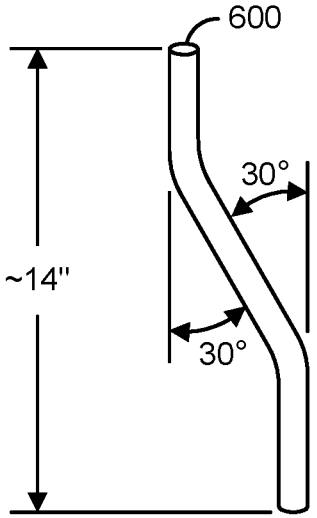
FIG. 16 is a diagram illustrating an S-curve bent portion for use with the dual lever arm assist tool in accordance with embodiments of the invention.

Referring to FIG. 16, a diagram is shown illustrating an S-curve bent portion for use with the dual lever arm assist tool in accordance with embodiments of the invention. In an example, an S-shaped bent portion 600 may be implemented approximately 14 inches long with two bends instead of one. In an example, the two bends may each be approximately 30 degrees, but with opposite rotations. The S-shaped bent portion 600 may be used in place of the bent portions 114*a* and 114*b*, 214*a* and 214*b*, 314*a* and 314*b*, and 410. The shape of the S-shaped bent portion 600 generally takes advantage of the ergonomics of a user to improve leverage provided in assisting the user.

In various embodiments, the first and the second bent portions (e.g., 114*a* and 114*b*, 214*a* and 214*b*, 314*a* and 314*b*, 410, and 600) may be removably connected with bayonet-style connectors or spring tab style connectors. However, other methods of removably connecting the first and the second bent portions may be implemented to meet design criteria of a particular implementation.

In some embodiments, all or a portion of the dual lever arm assist tool may be covered with a foam material to enhance a gripability of the tool. In an example, the foam covering may comprise a closed cell foam material. In an example, the foam material may be similar to insulating foam used to cover pipes. In an example, the foam material may be nonabsorbent to facilitate easy cleaning and sanitizing. In some embodiments, all or a portion of the dual lever arm assist tool may be covered with a heat shrinkable tubing such as: modified chlorinated polyolefin NST Tubing available from 3M Electrical Specialties Division, 6801 River Place Blvd., Austin, Tex. 78726-9000; Textured Grip Heat Shrinkable Tubing available from www.buyheatshrink-.com, a division of CSA Technical Solutions, LLC, 1980 NW 44th St Deerfield Beach, Fla. 33064. However, other types of covering may be used to enhance gripability for improved control.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. An apparatus comprising:

a tubular structure comprising a U-shaped portion, a first lever arm, and a second lever arm, wherein (i) the first lever arm comprises a first curved portion, a first straight portion, and a first bent portion, (ii) the second lever arm comprises a second curved portion, a second straight portion and a second bent portion, (iii) a first end of the U-shaped portion is connected to a first end of the first curved portion of the first lever arm, (iv) a second end of the U-shaped portion is connected to a first end of the second curved portion of the second lever arm, (v) a second end of the first curved portion is connected to a first end of the first straight portion of the first lever arm, (vi) a second end of the second curved portion is connected to a first end of the second straight portion of the second lever arm, (vii) a second end of the first straight portion of the first lever arm is removably connected to the first bent portion of the first lever arm, (viii) a second end of the second straight portion of the second lever arm is removably connected to the second bent portion of the second lever arm, (ix) the U-shaped portion is aligned with a first plane, (x) the first lever arm is aligned in a second plane, (xi) the second lever arm is aligned in a third plane, (xii) the second and the third planes are parallel to each other and perpendicular to the first plane, (xiii) the first curved portion has a radius of about six inches and forms an arc of about 120 degrees, (xiv) the second curved portion has a radius of about six inches and forms an arc of about 120 degrees, (xv) the first bent portion has a bend of about 30 degrees, (xvi) the second bent portion has a bend of about 30 degrees, and (xvii) in a first mode, the apparatus allows an individual to maintain balance while walking around their environment by standing within said U-shaped portion and between said first and said second lever arms, with said first and said second bent portions supporting said apparatus.

2. The apparatus according to claim 1, wherein:

the U-shaped portion comprises a third straight portion, a fourth straight portion, a fifth straight portion, a third curved portion, and a fourth curved portion;

the third straight portion has a first end connected to a first end of the third curved portion and a second end connected to a first end of the fourth curved portion;

a second end of the third curved portion is connected to a first end of the fourth straight portion; and a second end of the fourth curved portion is connected to a first end of the fifth straight portion.

3. The apparatus according to claim 2, wherein the third and the fourth curved portions comprise bends of approximately ninety degrees.

4. The apparatus according to claim 2, wherein the U-shaped portion further comprises a sixth straight portion attached parallel to the third straight portion extending outward on both sides of the U-shaped portion.

5. The apparatus according to claim 1, wherein the tubular structure comprises one inch diameter tubing.

6. The apparatus according to claim 1, wherein the first and the second bent portions can be rotated 180 degrees from a first position to a second position, in the first position the first and the second bent portions operate as feet of the apparatus, and in the second position the first and the second bent portions operate as handles of the apparatus.

7. The apparatus according to claim 1, wherein the first and the second bent portions are removably connected with bayonet-style connectors.

8. The apparatus according to claim 1, wherein the first and the second bent portions are removably connected with spring tab connectors.

9. The apparatus according to claim 1, wherein the first and the second bent portions comprise two bends that are a difference between the arcs of the first and second curved portions and 90 degrees.

10. The apparatus according to claim 1, wherein in a second mode for assisting the individual from a prostrate position to a kneeling position, the first and the second bent portions are replaced by a third bent portion and a fourth bent portion, and the third and the fourth bent portions comprise arcs of approximately ninety degrees.

11. The apparatus according to claim 1, wherein a portion of the U-shaped portion is covered with a foam covering to enhance grip.

12. The apparatus according to claim 1, wherein a section of angle-iron is attached to a portion of the U-shaped portion to provide enhanced stability when the U-shaped portion is in contact with a flat surface.

13. A method of assisting an individual rise from a prostrate position, the method comprising the steps of:

placing a dual lever arm assist tool under the head, neck, or shoulders of the individual such that lever arms of the tool are adjacent to the chest of the individual, wherein (i) the dual lever arm assist tool comprises a U-shaped portion, a first lever arm, and a second lever arm, (ii) the first lever arm comprises a first curved portion, a first straight portion, and a first bent portion, (iii) the second lever arm comprises a second curved portion, a second straight portion and a second bent portion, (iv) a first end of the U-shaped portion is connected to a first end of the first curved portion of the first lever arm, (v) a second end of the U-shaped portion is connected to a first end of the second curved portion of the second lever arm, (vi) a second end of the first curved portion is connected to a first end of the first straight portion of the first lever arm, (vii) a second end of the second curved portion is connected to a first end of the second straight portion of the second lever arm, (viii) a second end of the first straight portion of the first lever arm is removably connected to the first bent portion of the first lever arm, (ix) a second end of the second straight portion of the second lever arm is removably connected to the second bent portion of the second lever arm, (x) the U-shaped portion is aligned with a first plane, (xi) the first lever arm is aligned in a second plane, (xii) the second lever arm is aligned in a third plane, (xiii) the second and the third planes are parallel to each other and perpendicular to the first plane, (xiv) the first curved portion has a radius of about six inches and forms an arc of about 120 degrees, (xv) the second curved portion has a radius of about six inches and forms an arc of about 120 degrees, (xvi) the first bent portion has a bend of about 30 degrees, and (xvii) the second bent portion has a bend of about 30 degrees, rotating the lever arms by at least one of the bent portions toward the feet of the individual until the individual is sitting up;

arranging the dual lever arm assist tool such that the U-shaped portion, the first bent portion of the first lever arm, and the second bent portion of the second lever arm are in contact with a surface on which the individual is sitting;

using the dual lever arm assist tool to help the individual into a kneeling position;

arranging the dual lever arm assist tool such that the first bent portion of the first lever arm and the second bent portion of the second lever arm are in contact with the surface on which the individual is kneeling, and the U-shaped portion is above the first bent portion of the first lever arm and the second bent portion of the second lever arm; and using the dual lever arm assist tool to help the individual into a standing position, wherein the dual lever arm assist tool allows the individual to maintain balance while walking around their environment by standing within said U-shaped portion and between said first and said second lever arms, with said first and said second bent portions supporting the dual lever arm assist tool.

14. The method according to claim 13, wherein all or a portion of the dual lever arm assist tool is covered with a foam covering to enhance grip.

15. The method according to claim 14, wherein said foam covering comprises a closed cell foam.

16. The method according to claim 13, wherein a section of angle-iron is attached to a portion of the U-shaped portion to provide enhanced stability when the U-shaped portion is in contact with a flat surface.

* * * * *